United States Patent [19]

Nardozzi, Jr.

[11] Patent Number: 4,506,888

[45] Date of Patent: Mar. 26, 1985

[54] GOLF PUTTER WITH INTERCHANGEABLE SHAFTS AND HEADS

[76] Inventor: Michael Nardozzi, Jr., 255 Richland Dr., Pittsburgh, Pa. 15235

[21] Appl. No.: 483,518

[22] Filed: Apr. 11, 1983

[51] Int. Cl.[3] ..... A63B 53/02; A63B 53/06

[52] U.S. Cl. ..... 273/80.1; 273/168; 273/80 C

[58] Field of Search ..... 273/80.1, 168, 80 C, 273/80.2–80.9, 171, 77 A, 173, 174

[56] References Cited

U.S. PATENT DOCUMENTS

| | | | |
|---|---|---|---|
| 749,174 | 1/1904 | Davis | 273/168 X |
| 2,530,446 | 11/1950 | Beardsley | 273/168 X |
| 2,661,952 | 12/1953 | Jackson | 273/80.1 |
| 2,932,515 | 4/1960 | May | 273/80.1 |
| 3,191,936 | 6/1965 | Guier | 273/80.1 |
| 3,206,206 | 9/1965 | Santosuosso | 273/80.1 |
| 3,333,854 | 8/1967 | White | 273/80.1 X |
| 3,448,981 | 6/1969 | Anweiler | 273/80 C |
| 3,829,092 | 8/1974 | Arkin | 273/80.1 X |
| 3,893,670 | 7/1975 | Franchi | 273/80.1 |
| 4,111,426 | 9/1978 | Goodwin | 273/80.1 X |

*Primary Examiner*—George J. Marlo
*Attorney, Agent, or Firm*—Stanley J. Price, Jr.; John M. Adams

[57] ABSTRACT

A putter shaft has a lower end portion extending angularly relative to the shaft longitudinal axis and is slidably engageable with a guideway in the top of a removable putter head. The guideway extends substantially the length of the putter head and includes an entry at one end portion and a stop at the opposite end portion. The guideway is selectively oriented relative to a striking surface of the putter head so that when a shoulder on the shaft lower end portion abuts the guideway stop, the putter head is in the desired spatial relation with the putter shaft. Cooperating releasable locking devices carried on the lower end portion of the putter shaft and within the guideway of the putter head engage to secure the putter head to the shaft when the putter head is in the operative position on the shaft lower end portion. The cooperating locking devices are easily disengaged to facilitate disconnection of the putter head from the shaft for change of putter heads of different weight and configuration on the shaft, or change of different types of shafts for one or more types of putter heads.

10 Claims, 10 Drawing Figures

GOLF PUTTER WITH INTERCHANGEABLE SHAFTS AND HEADS

BACKGROUND OF THE INVENTION

1. Field of the Invention

This invention relates to a golf club having a releasable connection between the club head and the club shaft and, more particularly, to a golf putter that includes a putter head releasably connected to the putter shaft to permit a change in the weight and configuration of the putter head, as well as a change in the type of shaft used with a selected putter head.

2. Description of the Prior Art

Since putting is the most personal and delicate stroke in golf, golfers are particular about selecting a putter which will feel comfortable in a particular stance and provide for optimum mental concentration in executing the putting stroke. Due to the nature of the putting stroke and the high degree of concentration, and therefore comfort necessary to produce the desired results, putting is more easily affected by environmental and personal influences than any of the other strokes executed in a golf game. The lie of the ball on the putting green, the "speed" of the green, and the mental attitude of the golfer are the principal factors which charge with each putting stroke. The "speed" of the green determines the resistance of the golf ball to movement on the surface of the green and is determined by such factors as the length, thickness, variety, and moisture content of the grass, as well as season of the year and the air temperature. It is well known that these factors determine the force with which the ball is struck in order to obtain the desired results. Accordingly, the weight of the putter head determines to a great extent the nature of the putting stroke. For a given distance, a putter with a heavy head, such a mallet head putter, requires a shorter stroke than a putter having a bladed head.

It is well known to provide putters in which the weight of the head may be adjusted, as well as the angle between the longitudinal axis of the shaft and the head. It is also known to provide putters which can be adjusted for use for either a right-handed of left-handed player. U.S. Pat. No. 2,932,515 discloses a putter in which the weight of the putter is adjusted by attaching any desired number of weighted plates by means of bolts to an abutment face of the putter head. The desired number of weighted plates are bolted to the face until the putter has the proper feel for the individual golfer in response to the above discussed conditions which affect the putting stroke.

U.S. Pat. No. 3,191,936 also discloses an adjustable putter having a putter head provided with holes on opposite sides at the point of connection of the end of the shaft to the putter head for receiving weights. The weights may be of any material, such as lead, in the shape of wafers which are driven into the holes in the numbers desired to give the golfer the desired feeling of balance across the sweet spot on the striking surface of the putter head. The shaft of the putter includes a neck portion which is bendable to provide adjustments in the angle the shaft makes with the plane of the ground.

U.S. Pat. No. 3,206,206 also discloses a golf putter in which the angle the shaft makes with the plane of the ground when the putter head is positioned on the ground adjacent the ball is adjustable. The shaft and the putter head are adjustably connected to one another to permit the shaft to be moved angularly with respect to the putter head and also to be rotated axially with respect to the putter head. A removable connection is provided between the end of the shaft and the putter head.

It is also known as disclosed in U.S. Pat. No. 3,333,854 to provide a golf putter which may be converted from a conventional putter having a planar vertical face to a putter having a striking surface with a cutaway portion so that the upper one-half of the striking surface projects forwardly and is parallel to the lower half of the striking surface. Due to the cut-away portion when the ball is stroked, the ball is given an overspin when contacted by only the upper one-half of the striking surface. A bar is provided to fill the cut-away portion so that when the bar is used, the putter functions in a conventional manner. Additional patents disclosing interchangeable heads for golf clubs are U.S. Pat. Nos. 3,829,092 and 3,893,670.

While it has been suggested by the prior art devices to provide adjustable putters in which the weight of the putter head can be changed, the known devices require an exercise in judgment in the number of plates to be attached to the putter head or the number of lead wafers to be inserted in holes in the putter head. The plates are readily added or removed; however, when wafers are used they must be drilled out to decrease the weight of the putter head. These arrangements for varying the weight of a putter head are considered undesirable because they substantially leave to chance the weight which is selected in response to the desired results. The use of plates or lead wafers to change the weight of a putter head concentrates the additional weight at a point or points on the putter head. This does not provide a solid sense of balance for the putter head because the weight is not distributed uniformly throughout the entire body of the putter head. Therefore, there is need for a golf putter in which the putter head can be changed and, for each head selected, a solid sense of balance is provided throughout the entire putter head.

SUMMARY OF THE INVENTION

In accordance with the present invention, there is provided a golf club having interchangeable head and shaft portions that includes a club shaft having a longitudinal axis and a lower end portion. The lower end portion includes a shoulder. A club head has a striking face on one side thereof. A guideway in the club head is oriented in a preselected position relative to the striking face. The guideway has an entry and a stop spaced from the entry. The shoulder on the shaft lower end portion is received through the entry to a position in the guideway abutting the stop to mount the club head on the shaft in the position where the striking face is maintained in a preselected orientation relative to the longitudinal axis of the club shaft. Interconnecting means is carried on the club shaft lower shaft portion and on the club head within the guideway for releasably securing the club head to the club shaft when the shoulder abuts the stop to permit selected removal of said club head and replacement of another on said club shaft and removal of said club shaft and replacement of another on said club head.

Further in accordance with the present invention, there is provided a golf putter that includes a putter shaft having a longitudinal axis and a lower end portion extending angularly from the longitudinal axis. A removable putter head having an elongated body includes an upper surface and a surface for striking a golf ball on one side of the body. Receiving means in the body upper surface guides the putter shaft lower end portion into engagement with the putter head. Receiving means is oriented in a preselected position relative to the striking surface to maintain the putter shaft longitudinal axis in preselected spatial relation with the striking surface. Cooperating locking means on the putter shaft lower end portion and the receiving means releasably secures the putter head to the putter shaft in the preselected spatial relation.

Further in accordance with the present invention, there is provided a method for interchanging the components of a golf club that includes the steps of slidably removing a first club head from engagement with the lower end portion of a club shaft. The lower end portion of the club shaft is aligned with a guideway extending in the body of a second club head as a replacement for the first club head on the shaft. The club shaft lower end portion is moved to a first position in the guideway. The club shaft lower end portion is slidably advanced in the guideway from the first position to a second position where the longitudinal axis of the club shaft is oriented in preselected spatial relation with the striking face of the club head. Locking means carried by the club shaft lower end portion and by the club head in the guideway are actuated when the club shaft lower end portion is in the second position to releasably connect the club head to the club shaft and facilitate the replacement of the second club head for the first club head on the club shaft lower end portions.

Accordingly, the principal object of the present invention is to provide a gold club having a club head which is releasably connected to the end of the club shaft in a manner to facilitate substitution of one club head for another on the shaft to permit the golfer to adjust to various conditions encountered to achieve the desired results in a golf game.

Another object of the present invention is to provide a golf putter having a releasable connection between the putter head and the putter shaft to permit a change of the putter head on the shaft to, thereby, change the weight and/or configuration of the putter head.

An additional object of the present invention is to provide a gold putter in which the weight of the putter is adjusted by replacing one putter head for another on the shaft in a manner which is easily accomplished and assures correct positioning of the putter head with respect to the putter shaft.

A further object of the present invention is to provide a golf putter having a shaft which is releasably connected to the putter head in a manner to facilitate a change in the weight and configuration of the putter head on the shaft, as well as a change in the configuration of the shaft utilized with a selected putter head.

Another object of the present invention is to provide a multipurpose golf putter convertible to both right and left hand use and adjustable in weight and configuration by matching a selected shaft with a selected putter head.

Another object of the present invention is to provide a method for changing the weight of a golf putter in a manner which assures a solid sense of balance of the putter for every weight utilized.

A further object of the present invention is to provide a method for releasably connecting a putter head to a putter shaft in a manner that secures the putter head in a precise orientation relative to the shaft and is easily removed therefrom without the use of tools or the engagement and disengagement of fasteners.

These and other objects of the present invention will be more completely disclosed and described in the following specification, the accompanying drawings, and the appended claims.

DESCRIPTION OF THE PREFERRED EMBODIMENTS

Figure 1:
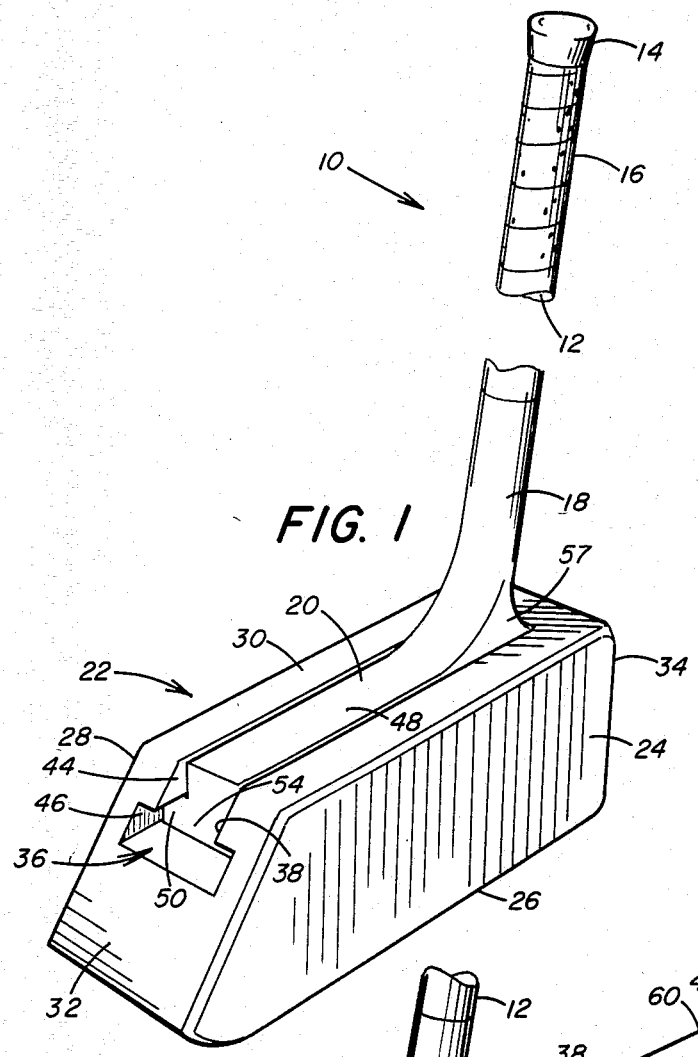
FIG. 1 is an enlarged fragmentary, isometric view of a gold putter having a putter head releasably connected to the lower end portion of the putter shaft.
Figure 2:
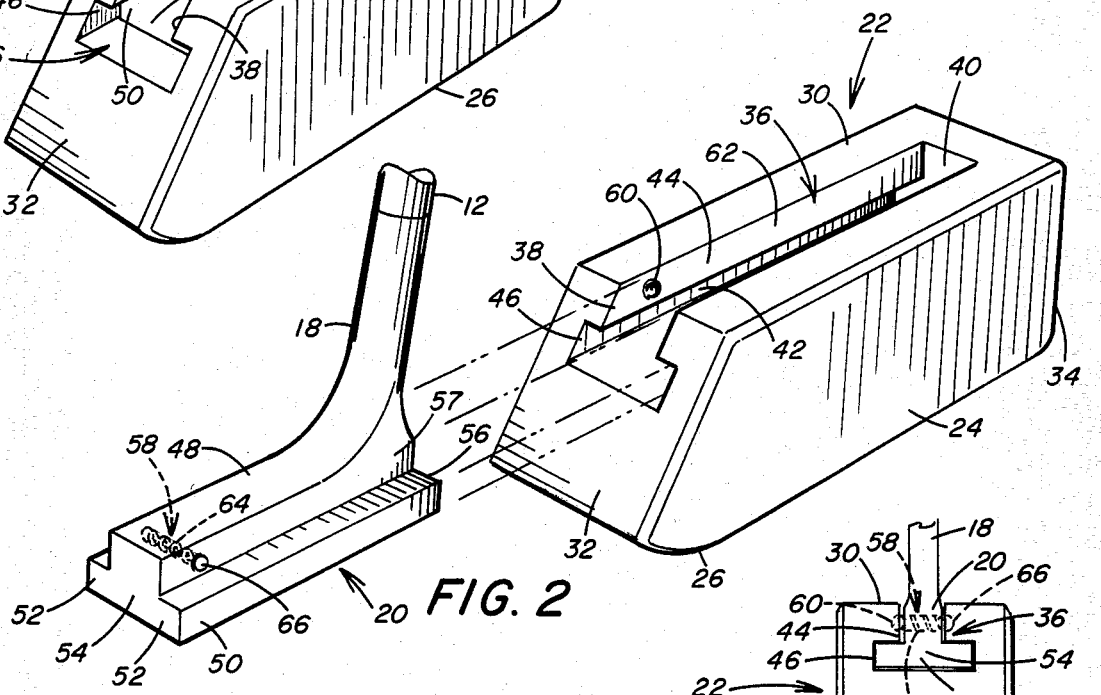
FIG. 2 is a fragmentary, exploded, isometric view of the golf putter shown in FIG. 1, illustrating the lower end portion of the putter shaft removed from the putter head.
Figure 3:
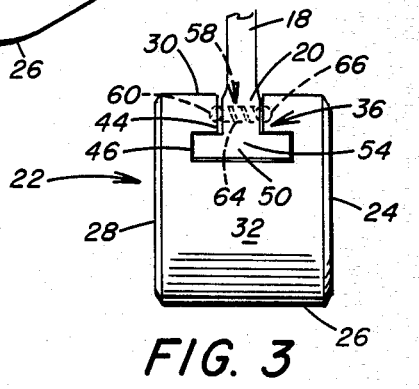
FIG. 3 is a fragmentary, front view of the putter head shown in FIG. 1, illustrating the releasable connection of the putter head to the putter shaft.

Referring to the drawings and, particularly to FIGS. 1–3, there is illustrated a golf club generally designated by the numeral 10 that includes a club shaft 12 which may be fabricated of a selected material such as tubular metal, graphite, fiberglass, wood, etc. The club shaft 12 includes an upper end portion 14 having a grip or handle portion 16, only part of which is shown. The club shaft 12 has a longitudinal axis that extends from the upper end portion 14 to a shaft neck 18. A lower end portion 20 of the shaft 12 extends from the neck 18 at an angle relative to the longitudinal axis of the shaft 12. The lower end portion 20 has a preselected configuration adapted to form a support for releasably receiving a club head 22 in a fixed position relative to the longitudinal axis of the club shaft 12. The club head 22 illustrated in FIGS. 1–3 has the configuration of a putter head to thereby permit use of the golf club 10 as a putter; however, it should be understood that the present invention is not limited in scope to golf putters but is applicable to all types of golf clubs.

The putter head 22 also may be fabricated of a preselected material, for example, metal, plastic, fiberglass, etc. In accordance with the present invention, the putter head 22 is releasably connected to the shaft lower end portion 20 so as to facilitate a change of the putter head 22 on the shaft 12. This permits a plurality of putter heads each differing in weight and configuration, to be utilized with a selected shaft 12 so as to provide the golfer with the ability to change the weight and configuration of the putter head 22 in response to the varying conditions encountered on the golf course, such as the lie of the ball on the green and the "speed" of the green.

Figure 5:
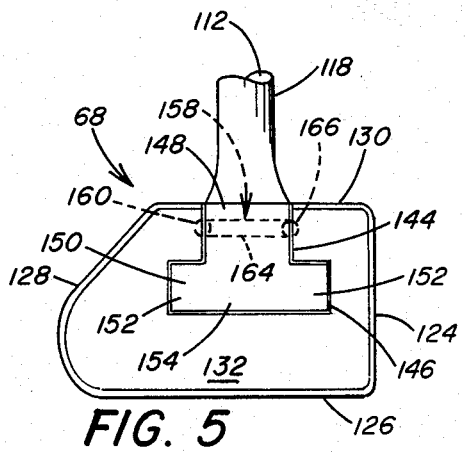
FIG. 5 is a front view of the putter head shown in FIG. 4.
Figure 6:
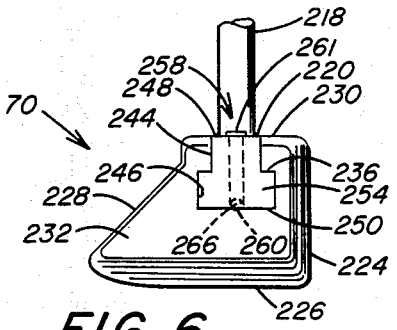
FIG. 6 is a fragmentary front view of another embodiment of a putter head releasably connected to the lower end portion of the putter shaft.

Regardless of the configuration of the putter head 22 which, for example, may be in the form of a mallet, as illustrated in FIG. 1, or a blade-type putter head having relatively narrow width and a high silhouette, each putter head 22 has a striking face or blade surface 24 positioned in a substantially vertical plane when the putter head 22 is soled on the ground. The putter head 22 includes a lower surface or sole 26 which is soled on the ground when the golfer addresses the ball by positioning the striking face 24 closely behind and spaced from the ball. Positioned oppositely of the striking face 24 is a rear or trailing face 28 which may be parallel to the striking face 24 or at an angle relative thereto, as shown in FIGS. 5 and 6. An upper surface 30 extends between the opposed faces 24 and 28 on the putter head 22. Further, the putter head 22 includes a toe or forward end portion 32 and a heel or rearward end portion 34.

The putter head 22 has a generally elongated body, and on the upper surface 30 of the body is positioned an elongated guideway, generally designated by the numeral 36, adapted for slidably, releasably receiving the club shaft lower end portion 20. The guideway 36 is oriented in a preselected position relative to the plane of the striking face 24. Preferably, the guideway 36 extends parallel to the plane of the striking face 24. The guideway 36 has an opening or entry 38 that extends through the toe 32 to a stop 40 which is spaced a distance from the heel 34. Thus, the guideway 36 extends substantially the length of the putter head 22; however, it should also be understood that a similar arrangement can be provided for the guideway 36 to extend transversely from the trailing face 28 to a position adjacent the striking face 24.

Further in accordance with the present invention, the shaft lower end portion 20 and the putter head guideway 36 have cooperating surfaces that slidably receive one another so as to permit the putter head 22 to be freely guided into and out of a fixed position on the shaft lower end portion 20. In the fixed or final position of the putter head 22 on the shaft lower end portion 20, the putter striking face 24 is maintained in a preselected orientation relative to the longitudinal axis of the putter shaft 12. For example as illustrated in FIGS. 1 and 3, when the putter head 22 is in the fixed position on the shaft lower end portion 20, the longitudinal axis of the shaft 12 is positioned rearwardly of the putter head striking face 24.

As illustrated in FIGS. 1-3, the guideway 36 has the configuration of an outwardly opening, elongated slot or channel 42 having two adjoining passages or slots 44 or 46 of different widths adapted to slidably receive the shaft lower end portion 20. The adjoining passages 44 and 46 have different widths so as to securely retain the shaft lower end portion 20 in the channel 42 while permitting the putter head 22 to be easily removed from connection with the shaft lower end portion 20.

The shaft lower end portion 20, as illustrated in greater detail in FIG. 2, has a top portion 48 of a width corresponding to the width of passage 44 and a base portion 50 having a width corresponding to the width of passage 46. The top portion 48 and the base portion 50 are integrally formed and provide shoulders 52 on opposite sides of the lower end portion 20. The shoulders 52 extend the length of the base portion 50 and have a length which substantially corresponds to the length of the channel 42. With this arrangement the shoulders 52 form a guide rail having a front end portion 54 and a rearward end portion 56. Connecting the shaft neck 18 to the guide rail end portion 56 is a shoulder 57.

To assemble the putter head 22 on the shaft 12, the shaft lower end portion 20 is aligned oppositely of the putter head 22 as illustrated in FIG. 2 so that the rear shoulder 57 is initially advanced into the entry 38 of the guideway 36. The base portion 50 is received in the larger passage 46, and the top portion 48 is received in the smaller passage 44. Further, as seen in FIG. 1, the depth of the guideway 36 corresponds to the vertical thickness of the lower end portion 20 so that when the putter head 22 is assembled on the shaft lower end portion 20, the top portion 48 forms a continuous planar surface with the upper surface 30 of the putter head 22.

Once the rearward end portion 56 is positioned in the guideway entry 38, the shaft lower end portion 20 is then forcibly, slidably advanced in the passageway 36 until the shoulder 57 on the end portion 56 abuts the stop 40 of the guideway 36. Thus, when the lower end portion 20 can be advanced no further into the guideway 36, the putter head 22 is located in the operative position on the shaft 12.

In the operative position of the putter head 22 on the shaft lower end portion 20, the putter head 22 is securely fixed to the shaft 12 by the provision of cooperating locking devices carried by both the putter head 22 in the guideway 36 and on the shaft lower end portion 20. The cooperating locking devices may take a variety of forms. As illustrated in FIGS. 2 and 3, one embodiment of the locking devices includes a spring biased detent 58 carried transversely in the shaft lower end portion 20. Preferably the spring biased detent 58 is positioned at the front end portion 54 and extends the width of the top portion 48. The spring biased detent 58 includes a spring 64 securely positioned in a bore through the top portion 48. Ball members 66 are securely retained in the ends of the spring 64 to project outwardly beyond the sides of the top portion 48. The ball members 66 are movable with the spring 64. The putter head 22 includes a pair of indents 60 positioned in walls 62 which form the guideway passage 44. The indents 60 are sized to receive the ball members 66.

When the shaft lower end portion shoulder 57 abuts the guideway stop 40, the spring biased detent 58 is aligned with the indents 60 so that the spring 64 urges ball members 66 into engagement with the indents 60. The spring 64 firmly seats the ball members 66 in the indents 60 to fix the shaft lower end portion 20 in the desired position in the guideway 36. This arrangement assures the desired spatial relation between the putter striking face 24 and the longitudinal axis of the putter shaft 12. Accordingly, to remove the putter head 22 from the shaft lower end portion 20, the golfer grasps the putter head 22 in one hand and the shaft 12 at the neck portion 18 in the other and then pulls the shaft 12 in a direction to slide the lower end portion 20 through the entry 38 of the guideway 36 with sufficient force to overcome the force of the detent spring 64.

Thus, with the above described locking devices of the present invention, the putter head 22 is easily connected to and disconnected from the putter shaft 12. This facilitates quick change of a putter head on the shaft lower end portion 20. Thus the putter head 22 can be changed to increase or decrease the weight of the putter head, as well as the configuration of the putter head on a shaft 12. Not only may putter heads of different weights and shapes be utilized with a preselected type of putter shaft, but different types of putter shafts may be utilized with one or more types of putter heads.

Figure 4:
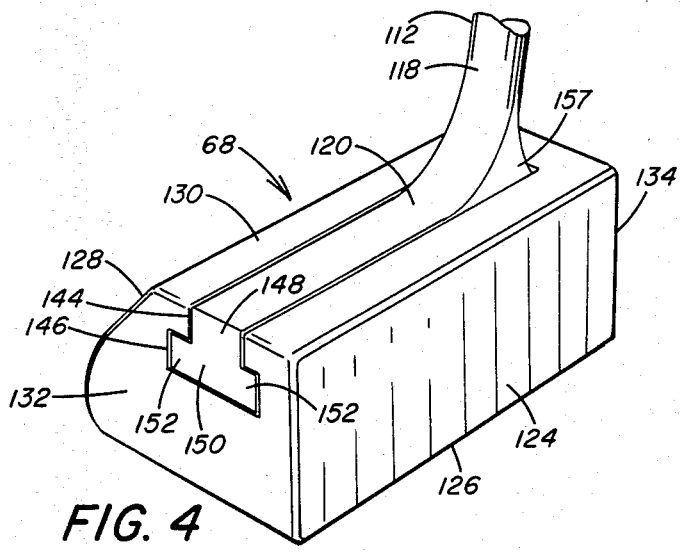
FIG. 4 is an enlarged fragmentary, isometric view of a gold putter similar to FIG. 1, illustrating another embodiment of a putter head releasably connected to the lower end portion of the putter shaft.

Referring to FIGS. 4 and 5, there is illustrated another embodiment of a putter head generally designated by the numeral 68 in which like numerals shown in FIGS. 1–3 refer to like parts shown in FIGS. 4 and 5 are raised by the magnitude of 100. The putter head 68 shown in FIG. 4 is similar to the putter head 22 shown in FIGS. 1–3; however, the putter head 68 has a lower silhouette and the trailing face 128 extends at an angle relative to the striking face 24. Also with the putter head 68, the lower surface 126 has a width greater than the upper surface 130 in comparison with the configuration of the putter head 22.

As desired by a golfer in response to results to be achieved for the prevailing putting conditions, the putter head 22 may be replaced for the putter head 68. Accordingly, while a change of putter heads on a shaft accomplishes a change in the putter head configuration and weight, the change is accomplished in a manner that maintains a solid sense of balance in the use of the putter 10. The golfer is able to retain the use of a preselected putter shaft 12 with a variety of putter heads. This is particularly advantageous when the golfer desires to retain the use of a shaft that feels comfortable to him. The golfer does not encounter the inconvenience of having to become accustomed to a change in the style of a preferred style of shaft when it is desired to change the weight or configuration of the putter head. This could not be accomplished heretobefore when a golfer was required to change putter shafts in order to change the configuration of the putter head.

Figure 7:
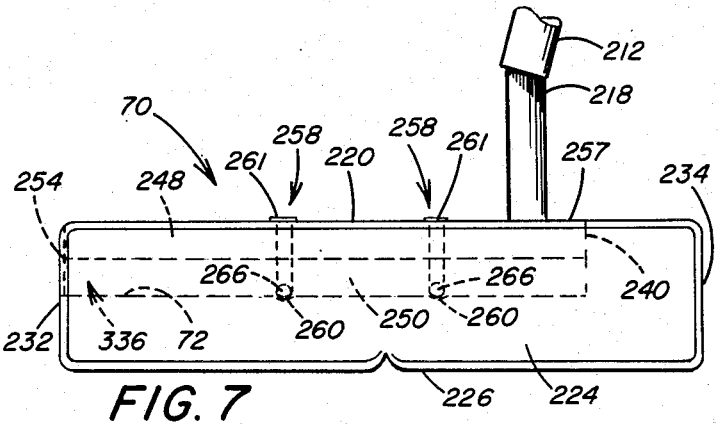
FIG. 7 is a fragmentary view in side elevation of the putter head shown in FIG. 6, illustrating an embodiment of a putter shaft having a neck portion which is offset from the longitudinal axis of the putter shaft.
Figure 8:
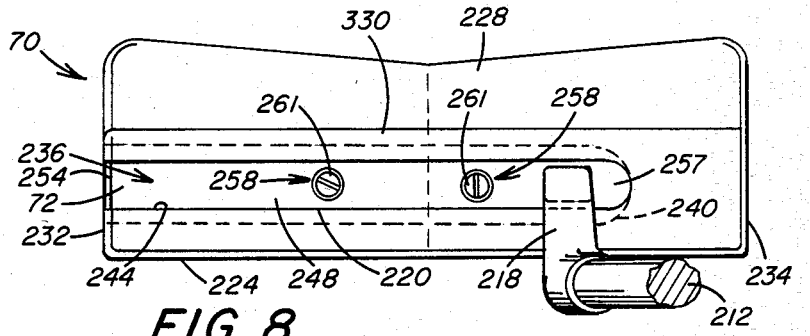
FIG. 8 is a fragmentary top plan view of the putter head shown in FIG. 7, illustrating the offset neck portion of the shaft where the striking face of the putter head is positioned rearwardly of the longitudinal axis of the putter shaft.

The present invention not only allows a change of putter heads for a putter shaft, but a change in the style of putter shafts used with a desired putter head is also possible. For example as illustrated in FIGS. 6–8 in which like parts shown in FIGS. 1–3 are designated by like numerals raised by the magnitude of 200, there is shown a flange-shaped putter head 70 having a preselected weight and configuration. The putter head 70 is also releasably engageable to the lower end portion 220 of the putter shaft 212 in which the shaft neck portion 218 connects the shaft 212 to the lower end portion 220.

The shaft neck portion 218 extends at an angle relative to the longitudinal axis of the shaft 212 as compared to the neck 118 for the shaft 112, illustrated in FIGS. 4 and 5, where the neck 118 is coaxial with the longitudinal axis of the shaft 112. The shaft neck portion 218, shown in FIG. 8, is offset from the shaft 212. With this embodiment, as with the above described embodiments of FIGS. 1–5, by advancing the shaft lower end portion 220 onto the putter head 70 from the toe 232 to the heel 234, the putter head 70 is further prevented from slipping off the lower end portion 220 when the putter is swung by the centrifugal force acting on the lower end portion 220 to maintain the shoulder 257 abutting the stop 240. Thus in accordance with this method of inserting the putter head 70 on the shaft lower end portion 220, not only is the putter head 70 easily removed from and inserted on the lower end portion 220, but once inserted is maintained securely in place when the putter is swung, preventing accidental removal of the putter head 70 from the shaft 212.

With the embodiment of the putter head 70 illustrated in FIGS. 6–8, the cooperating locking means for releasably connecting the putter head 70 to the shaft lower end portion 220 includes a plurality of spring biased detents 258. The spring biased detents 258 are carried vertically in the shaft lower end portion 220. Each of the detents 258 is well known in construction and includes a threaded member 261 that extends from the top portion 248 downwardly through a bore in the body of the lower end portion 220 to the base portion 250. A spring (not shown) is carried around the threaded member 261 and retains a ball member 266 at the end of the threaded member 261. Each ball member 266 is adapted to be received within an indent 260 in a base 72 of the guideway 236 when the shoulder 257 abuts the stop 240. A pair of indents 260 is spaced a preselected distance apart and positioned to receive the ball members 262 when the putter head 70 is in the operative position on the shaft lower end portion 220. The detents 258 are disengaged from the indents 260 in the manner described above for the locking devices illustrated in FIG. 2.

Figure 9:
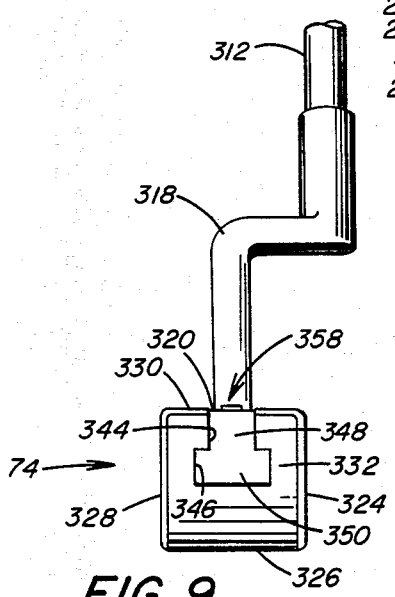
FIG. 9 is a fragmentary front view of another embodiment of a putter head releasably connected to an offset neck portion of a putter shaft.
Figure 10:
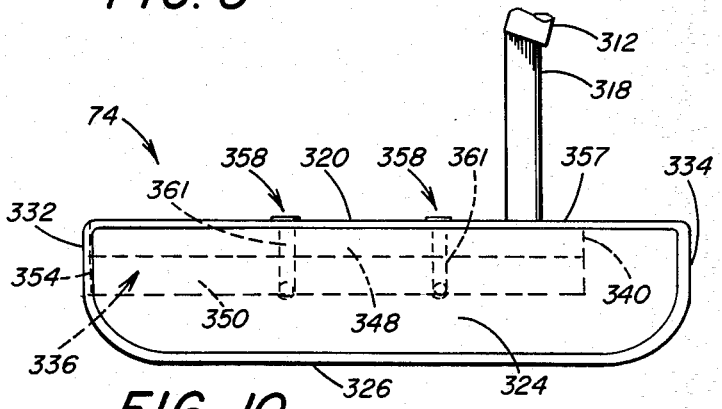
FIG. 10 is a fragmentary view in side elevation of the golf putter shown in FIG. 9.

Now referring to FIGS. 9 and 10 in which like parts shown in FIGS. 1–3 are designated by like numerals raised by the power of 300, there is illustrated another embodiment of a putter head generally designated by the numeral 74 having a weight and configuration that differs from each of the putter heads 22, 68 and 70 described above. Also shown in FIG. 9 the putter shaft 312 is connected by the offset neck 318 to the shaft lower end portion 320. Thus it can be seen that this configuration of the putter shaft 312, the longitudinal axis of the putter shaft 312 is slightly forward of the putter head striking face 324. Thus the golfer's hands on the shaft grip portion are slightly forward of the striking face 324 and accordingly, the ball when addressed.

In this manner the shaft 312 can be utilized with either one of the above described putter heads in place, for example, of the shaft 12 illustrated in FIG. 1. In the alternative, any one of the above described putter heads can be utilized with either the shaft 12 illustrated in FIG. 1 or the shaft 312 illustrated in FIG. 9. Thus a variety of combinations of putter heads and putter shafts for both left and right hand use are available to the golfer in accordance with the present invention, so that rather than face a bewildering variety of shaft configurations which may disturb the golfer's stance or stroke, the golfer is able to vary the weight and shape of the putter head without changing the style of the putter shaft. This has the advantage of maintaining an identical grip and shaft design, which are dependent mainly on the golfer's personal preference, while adjustments are made to the putter head in response to the results desired for the conditions encountered on a golf course. However, in the event that a change is desired in the grip and shaft configuration for a particular putter head, the shaft can be changed and the weight and configuration of the putter head remains the same.

According to the provisions of the patent statutes, I have explained the principle, preferred construction and mode of operation of my invention and have illustrated and described what I now consider to represent its best embodiments. However, it should be understood that within the scope of the appended claims, the invention may be practiced otherwise than as specifically illustrated and described.

I claim:

1. A golf club having interchangeable head and shaft portions comprising:

a club shaft having a longitudinal axis and a lower end portion, said lower end portion including a shoulder, a club head having a body portion with a striking face on one side thereof, said body portion having opposite end portions formed by a toe at one end and a heel at an opposite end, said striking face extending from said toe to said heel, a guideway extending in said club head parallel to the plane of said striking face from said toe to said heel spaced behind said striking face and along the length thereof, said guideway being open at said toe to form an entry into said guideway at said toe, said guideway being closed adjacent said heel to form a stop spaced from said entry, said shoulder on said shaft lower end portion being received through said entry and slidable in said guideway from said toe to said heel to a fixed position abutting said stop to mount said club head on said shaft at an angle relative to said shaft longitudinal axis so that when said club shaft is swung a force is applied to said shaft lower end portion to maintain said shoulder abutting said stop, and interconnecting means carried on said club shaft lower end portion and on said club head within said guideway for releasably securing said club head to said club shaft when said shoulder abuts said stop to permit selected removal of said club head and replacement of another on said club shaft and removal of said club shaft and replacement of another on said club head.

2. A golf club as set forth in claim 1 which includes, a trailing face positioned on said club head body portion on a side oppositely of said striking face, said guideway extending between said striking face and said trailing face, and said shaft lower end portion being releasably retained in said guideway so as to position said shaft longitudinal axis rearwardly of said striking face.

3. A golf club as set forth in claim 1 which includes, a trailing face positioned on said club head body portion on a side oppositely of said striking face, said shaft lower end portion being releasably retained in said guideway, a shaft neck portion extending between said shaft lower end portion and said shaft, and said shaft neck portion extending at an angle relative to said shaft longitudinal axis so as to position said shaft longitudinal axis forwardly of said striking face.

4. A golf club as set forth in claim 1 in which, said interconnecting means includes a spring biased detent extending through said shaft lower end portion into said guideway, an indent selectively positioned on said club head body portion in said guideway, and said spring biased detent engageable with said indent to retain said club head on said shaft lower end portion when said shoulder is positioned in abutting relation with said stop.

5. A golf club as set forth in claim 1 in which, said guideway includes a channel being formed by a pair of adjoining passages in which the width of one passage is greater than the width of the other passage, said passages extending from said entry to said stop, and said shaft lower end portion having guide rails slidably received within said pair of passages to guide said club head into and out of a fixed position on said shaft lower end portion where said shoulder abuts said stop.

6. A golf putter comprising, a putter shaft having a longitudinal axis and a lower end portion extending angularly from said longitudinal axis, said lower end portion including a shoulder, a removable putter head having an elongated body including an upper surface and a planar surface extending downwardly from said upper surface for striking a golf ball on one side of said body, said putter head body having opposite end portions with said planar surface extending therebetween, a toe positioned at said one body end portion and a heel positioned at said opposite body end portion, receiving means in said body upper surface for guiding said putter shaft lower end portion into engagement with said putter head, said receiving means including an elongated slot in said body upper surface extending from an entry at said toe through said one end portion to a stop adjacent said heel, said receiving means extending parallel to the plane of said planar striking surface to maintain said putter shaft longitudinal axis parallel to said planar striking surface, said putter shaft lower end portion being positioned in said slot by slidable movement through said entry from said toe to said heel, cooperating locking means on said putter shaft lower end portion and said receiving means for releasably securing said putter head to said putter shaft in said preselected spatial relation, and said locking means on said putter shaft lower end portion and within said slot being engageable when said putter shaft lower end portion shoulder abuts said stop to secure said putter head in a fixed position to said shaft.

7. A golf putter as set forth in claim 6 in which, said putter head is disconnected from said shaft by slidable movement of said putter shaft lower end portion out of said slot, and a second putter head having an elongated slot for receiving said putter shaft lower end portion to replace said first mentioned putter head for said second putter head on said putter shaft.

8. A golf putter as set forth in claim 6 in which, said putter shaft is disconnected from said putter head by slidable movement of said putter shaft lower end portion out of said slot, and a second putter shaft having a lower end portion being connected to said putter head by slidable movement of said second putter shaft lower end portion into said slot into abutting relation with said shoulder stop to replace said first mentioned putter shaft for said second putter shaft on said putter head.

9. A method for interchanging the components of a golf club comprising the steps of, releasably connecting a first club head to the lower end portion of a club shaft, slidably releasing the first club head from engagement with the lower end portion of the club shaft, aligning the lower end portion of the club shaft with a guideway extending in the body of a second club head as a replacement for the first club head on the shaft, moving the club shaft lower end portion to a first position in the guideway at the toe of the second club head, sliding the club shaft lower end portion in the guideway from the first position in a direction parallel to the plane of the striking face of the second club head to a second position at the heel of the second club head where the longitudinal axis of the club shaft is parallel to the striking face of the second club head, abutting a shoulder on the club shaft lower end portion with a stop at the end of the guideway to fix the position of the club head on the shaft lower end portion, actuating locking means carried by the club shaft lower end portion and by the club head in the guideway when the club shaft lower end portion is in the second position to releasably connect the club head to the club shaft and facilitate the replacement of the second club head for the first club head on the club shaft lower end portion, and maintaining the shoulder in contact with the stop when the golf club is swung by the centrifugal force applied to the club shaft lower end portion.

10. A method for interchanging the components of a golf club as set forth in claim 9 which includes, sliding the club shaft lower end portion out of the guideway to remove the club shaft from connection with a selected one of the first and second club heads, positioning the lower end portion of a second club shaft for insertion in the guideway of a selected one of the club heads, and advancing the second club shaft lower end portion of the second position in the guideway to securely connect the second club shaft to a selected one of the club heads.

* * * * *